US010498001B2

(12) United States Patent
Fruehling et al.

(10) Patent No.: US 10,498,001 B2
(45) Date of Patent: Dec. 3, 2019

(54) LAUNCH STRUCTURES FOR A HERMETICALLY SEALED CAVITY

(71) Applicant: TEXAS INSTRUMENTS INCORPORATED, Dallas, TX (US)

(72) Inventors: Adam Joseph Fruehling, Garland, TX (US); Benjamin Stassen Cook, Addison, TX (US); Juan Alejandro Herbsommer, Allen, TX (US); Swaminathan Sankaran, Allen, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

(21) Appl. No.: 15/681,541

(22) Filed: Aug. 21, 2017

(65) Prior Publication Data

US 2019/0058232 A1 Feb. 21, 2019

(51) Int. Cl.

| | |
|---|---|
| ***H01P 5/107*** | (2006.01) |
| ***H01P 3/12*** | (2006.01) |
| ***H01P 5/02*** | (2006.01) |
| ***H01P 7/06*** | (2006.01) |
| ***G04F 5/14*** | (2006.01) |
| *H01Q 15/00* | (2006.01) |
| *H01P 1/20* | (2006.01) |

(52) U.S. Cl.

CPC ..... *H01P 5/107* (2013.01); *G04F 5/14* (2013.01); *H01P 3/12* (2013.01); *H01P 5/02* (2013.01); *H01P 5/024* (2013.01); *H01P 7/065* (2013.01); *H01P 1/2005* (2013.01); *H01Q 15/006* (2013.01)

(58) Field of Classification Search

CPC ..... H01P 5/107; H01P 7/065

USPC ..... 333/230, 17.1; 331/94.1

See application file for complete search history.

(56) References Cited

U.S. PATENT DOCUMENTS

| | | | |
|---|---|---|---|
| 4,147,431 | A | 4/1979 | Mann |
| 4,826,616 | A | 5/1989 | Tanino |
| 5,107,231 | A | 4/1992 | Knox |
| 5,198,786 | A | 3/1993 | Russell et al. |
| 5,218,373 | A | 6/1993 | Heckaman et al. |

(Continued)

FOREIGN PATENT DOCUMENTS

| | | |
|---|---|---|
| JP | 6428974 | 1/1989 |
| WO | 2014037016 | 3/2014 |
| WO | 2016161215 | 10/2016 |

OTHER PUBLICATIONS

International Search Report for PCT/US2018/049513 dated Nov. 15, 2018.

(Continued)

*Primary Examiner* — Benny T Lee

(74) *Attorney, Agent, or Firm* — Michael A. Davis, Jr.; Charles A. Brill; Frank D. Cimino

(57) ABSTRACT

An apparatus includes a substrate containing a cavity and a dielectric structure covering at least a portion of the cavity. The cavity is hermetically sealed. The apparatus also may include a launch structure formed on the dielectric structure and outside the hermetically sealed cavity. The launch structure is configured to cause radio frequency (RF) energy flowing in a first direction to enter the hermetically sealed cavity through the dielectric structure in a direction orthogonal to the first direction. Various types of launch structures are disclosed herein.

14 Claims, 10 Drawing Sheets

(56) References Cited

U.S. PATENT DOCUMENTS

| | | | | |
|---|---|---|---|---|
| 5,412,186 | A | 5/1995 | Gale | |
| 5,459,324 | A | 10/1995 | Fima | |
| 5,821,836 | A * | 10/1998 | Katehi et al. | H01P 1/2088 333/202 |
| 6,131,256 | A | 10/2000 | Dydyk et al. | |
| 6,236,366 | B1 | 5/2001 | Yamamoto et al. | |
| 6,362,706 | B1 * | 3/2002 | Song et al. | H01P 5/107 333/219 |
| 6,498,550 | B1 * | 12/2002 | Miller et al. | H01P 1/2088 333/202 |
| 6,630,359 | B1 | 10/2003 | Caillat et al. | |
| 6,670,866 | B2 | 12/2003 | Ella et al. | |
| 6,842,088 | B2 | 1/2005 | Yamada et al. | |
| 6,989,723 | B2 | 1/2006 | Komuro et al. | |
| 6,998,691 | B2 | 2/2006 | Baugh | |
| 7,388,454 | B2 | 6/2008 | Ruby et al. | |
| 7,408,428 | B2 | 8/2008 | Larson, III | |
| 8,098,208 | B2 | 1/2012 | Ficker et al. | |
| 8,268,642 | B2 | 9/2012 | Yoshitomi et al. | |
| 8,293,661 | B2 | 10/2012 | Yamazaki | |
| 8,586,178 | B2 | 11/2013 | Schwanke et al. | |
| 9,436,902 | B1 | 9/2016 | Koepp et al. | |
| 9,529,334 | B2 | 12/2016 | Herbsommer et al. | |
| 9,735,754 | B2 | 8/2017 | Shin et al. | |
| 2002/0038989 | A1 | 4/2002 | Larson, III | |
| 2002/0068018 | A1 | 6/2002 | Pepper et al. | |
| 2002/0098611 | A1 | 7/2002 | Chang et al. | |
| 2003/0015707 | A1 | 1/2003 | Bosco et al. | |
| 2003/0048500 | A1 | 3/2003 | Fala et al. | |
| 2003/0107459 | A1 * | 6/2003 | Takahashi et al. | H01P 1/2088 333/230 |
| 2004/0142484 | A1 | 7/2004 | Berlin et al. | |
| 2004/0166577 | A1 | 8/2004 | Storek et al. | |
| 2005/0023932 | A1 | 2/2005 | Inoue et al. | |
| 2006/0022761 | A1 | 2/2006 | Abeles | |
| 2006/0076632 | A1 | 4/2006 | Palmateer et al. | |
| 2006/0144150 | A1 | 7/2006 | Wu | |
| 2007/0189359 | A1 | 8/2007 | Chen et al. | |
| 2008/0319285 | A1 | 12/2008 | Hancock | |
| 2010/0182102 | A1 | 7/2010 | Kuypers et al. | |
| 2010/0259334 | A1 | 10/2010 | Briggs | |
| 2010/0327701 | A1 | 12/2010 | Grannen et al. | |
| 2011/0140971 | A1 | 6/2011 | Schwanke et al. | |
| 2012/0266681 | A1 | 10/2012 | Baumann et al. | |
| 2013/0176703 | A1 | 7/2013 | Hopper et al. | |
| 2014/0155295 | A1 | 6/2014 | Hindson et al. | |
| 2014/0210835 | A1 | 7/2014 | Hong et al. | |
| 2014/0347074 | A1 | 11/2014 | Nadeau | |
| 2014/0368376 | A1 | 12/2014 | Nadeau et al. | |
| 2014/0368377 | A1 | 12/2014 | Nadeau et al. | |
| 2014/0373599 | A1 | 12/2014 | Trombley et al. | |
| 2015/0144297 | A1 | 5/2015 | Toivonen et al. | |
| 2015/0123748 | A1 | 7/2015 | Stevenson | |
| 2015/0277386 | A1 | 10/2015 | Passilly et al. | |
| 2016/0091663 | A1 | 3/2016 | Taylor | |
| 2016/0233178 | A1 | 8/2016 | Lamy et al. | |
| 2017/0073223 | A1 | 3/2017 | Nasiri et al. | |
| 2017/0125660 | A1 | 5/2017 | Stephanou et al. | |
| 2017/0130102 | A1 | 5/2017 | Campbell et al. | |
| 2018/0159547 | A1 | 6/2018 | Herbsommer et al. | |

OTHER PUBLICATIONS

International Search Report for PCT/US2018/049940 dated Dec. 13, 2018.

International Search Report for PCT/US2018/049949 dated Dec. 13, 2018.

International Search Report for PCT/US2018/049949 dated Dec. 27, 2018.

International Search Report for PCT/US2018/047105 dated Dec. 27, 2018.

International Search Report for PCT/US2018/050253 dated Jan. 10, 2019.

* cited by examiner

LAUNCH STRUCTURES FOR A HERMETICALLY SEALED CAVITY

BACKGROUND

Various applications may include a sealed chamber formed in a semiconductor structure. In one particular application, a chip-scale atomic dock may include a selected vapor at a low pressure in a sealed chamber. Injecting radio frequency (RF) signals into, or extracting RF signals, from a hermetically sealed chamber is a challenge.

SUMMARY

In some embodiments, an apparatus includes a substrate containing a cavity and a dielectric structure covering at least a portion of the cavity. The cavity is hermetically sealed. The apparatus also may include a launch structure formed on the dielectric structure and outside the hermetically sealed cavity. The launch structure is configured to cause radio frequency (RF) energy flowing in a first direction to enter the hermetically sealed cavity through the dielectric structure in a direction orthogonal to the first direction. Various types of launch structures are disclosed herein.

In another embodiment, an apparatus includes a substrate containing a cavity. The apparatus also may include a dielectric structure covering at least a portion of the cavity. The cavity is hermetically sealed. A launch structure may be formed on the dielectric structure and outside the hermetically sealed cavity. The launch structure is configured to cause radio frequency (RF) energy flowing in a first direction to enter the hermetically sealed cavity through the dielectric structure in a direction orthogonal to the first direction. The apparatus also may include a transceiver electrically coupled to the launch structure and configured to inject a transmit signal into the cavity through the launch structure, generate an error signal based on the transmit signal and a receive signal from the launch structure, and dynamically adjust a frequency of the transmit signal based on the error signal.

BRIEF DESCRIPTION OF THE DRAWINGS

For a detailed description of various examples, reference will now be made to the accompanying drawings in which.

DETAILED DESCRIPTION

Certain terms are used throughout the following description and claims to refer to particular system components. As one skilled in the art will appreciate, different parties may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" or "couples" is intended to mean either an indirect or direct wired or wireless connection. Thus, if a first device couples to a second device, that connection may be through a direct connection or through an indirect connection via other devices and connections. The recitation "based on" is intended to mean "based at least in part on." Therefore, if X is based on Y, X may be a function of Y and any number of other factors.

In an embodiment, an apparatus includes a substrate containing a cavity and a dielectric structure covering at least a portion of the cavity. The cavity is hermetically sealed. A launch structure is formed on the dielectric structure and outside the hermetically sealed cavity. The launch structure is configured to cause radio frequency (RF) energy flowing in a first direction to enter the hermetically sealed cavity through the dielectric structure in a direction orthogonal to the first direction. The disclosed embodiments are directed to various launch structures for the hermetically sealed cavity.

In one application, the hermetically sealed cavity and launch structure forms at least part of a chip-scale atomic clock. The cavity may contain a plurality of dipolar molecules (e.g., water molecules) at a relatively low pressure. For some embodiments, the pressure may be approximately 0.1 mbarr for water molecules. If argon molecules were used, the pressure may be several atmospheres. The hermetically sealed cavity may contain selected dipolar molecules at a pressure chosen to optimize the amplitude of a signal absorption peak of the molecules detected at an output of the cavity. An electromagnetic signal may be injected through an aperture into the cavity. Through closed-loop control, the frequency of the signal is dynamically adjusted to match the frequency corresponding to the absorption peak of the molecules in the cavity. The frequency produced by quantum rotation of the selected dipolar molecules may be unaffected by circuit aging and may not vary with temperature or other environmental factors.

Figure 1:
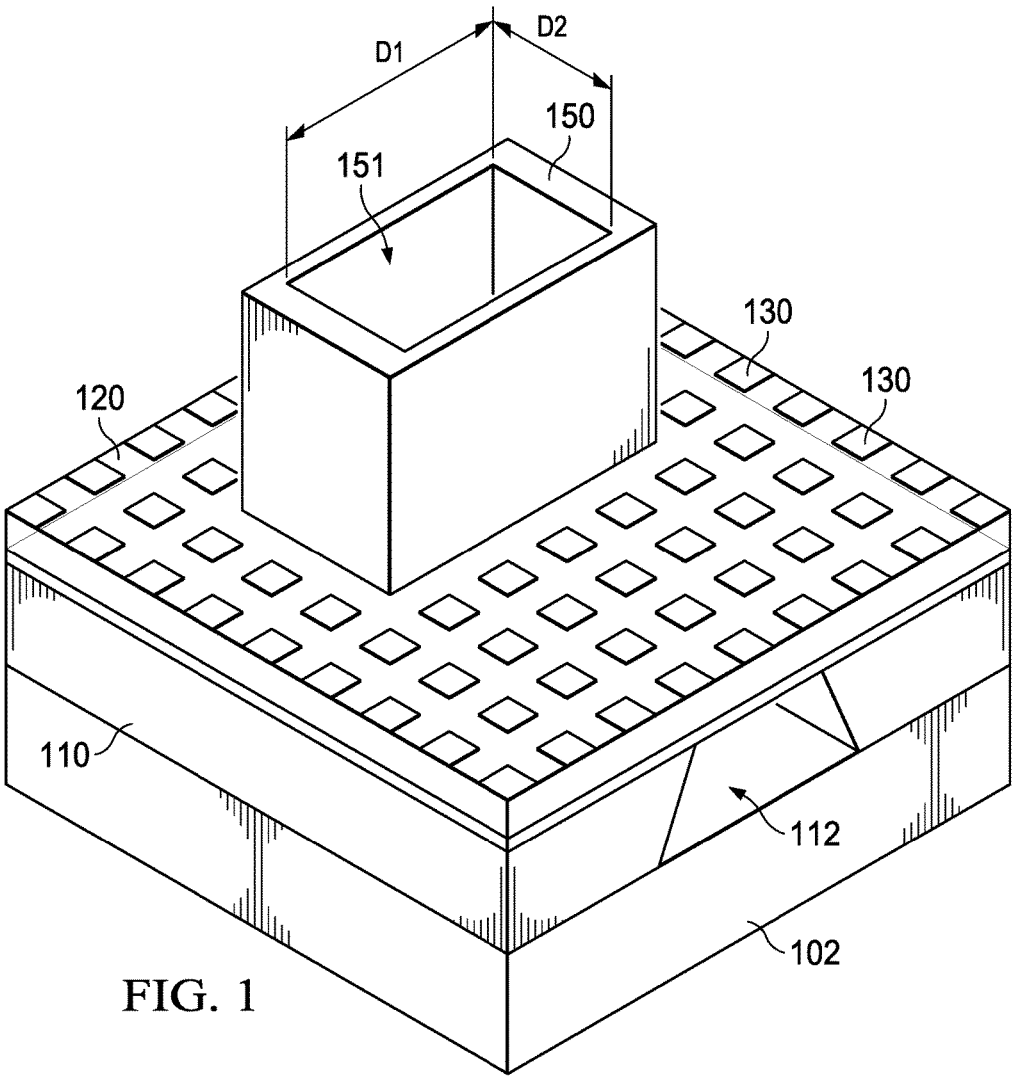
FIGS. 1 and 2 illustrate one embodiment of a launch structure comprising a rectangular waveguide an inductive current loops in accordance with various examples.
Figure 2:
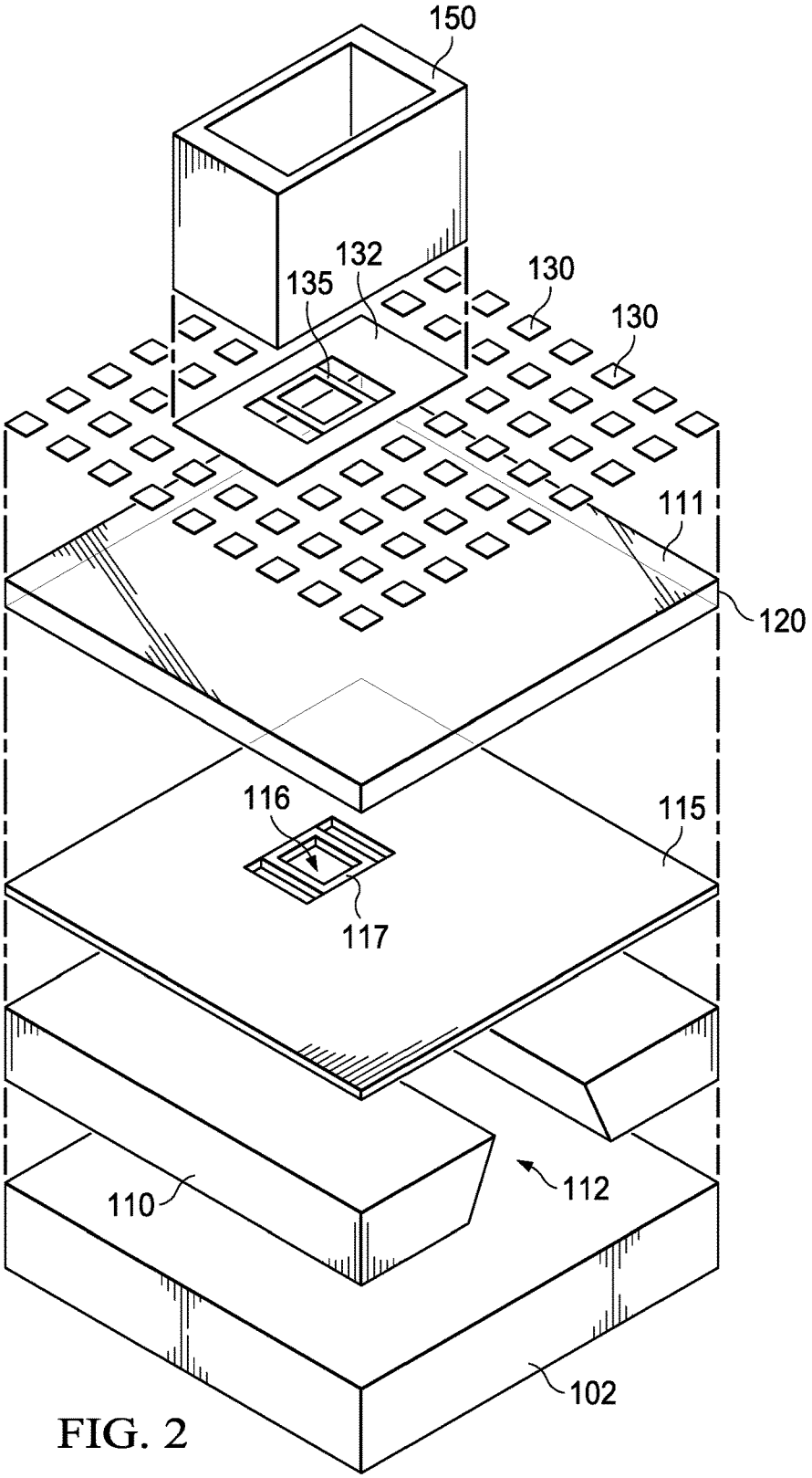

FIG. 1 illustrates an embodiment of a hermetically sealed cavity 112 formed in a substrate 110 with a particular launch structure attached thereto. FIG. 2 shows an exploded view of the apparatus. The substrate 110 is a semiconductor substrate (e.g., silicon) in some embodiments, but can be other than a semiconductor substrate in other embodiments, such as a ceramic material or a metal cavity. The cavity 112 may be created through wet etching the substrate 110 using a suitable wet etchant such as potassium hydroxide (KOH) or tetramethylammonium hydroxide (TMAH). Substrate 110 is bonded to another substrate 102 to seal the cavity 112.

Substrate 102 also may comprise a semiconductor substrate, or other type of material such as a metal coated ceramic or a dielectric.

As shown in FIG. 2, a metal layer 115 is deposited on a surface of substrate 110 and over cavity 112, the metal layer 115 opposite substrate 102. The metal layer 115 may comprise copper, gold, other type of metal. An iris 116 is patterned in the metal layer 115. The iris 116 is patterned by removing a portion of the metal layer 115 (e.g., by liftoff, wet etch or other suitable processes). An inductive current loop 117 (or multiple loops) of conductive material is formed within the iris 116, and couples to the metal layer 115, and functions to inductively couple to a corresponding inductive loop 135 formed on a surface of a dielectric structure 120 opposite the metal layer 115. The metal layer 115 thus is between the dielectric structure 120 and the substrate 102. The inductive loops 117, 135 are vertically aligned as shown so that the current in one of the inductive loops induces a current in the other of the inductive loops.

An electronic bandgap structure (EBG) 130 (FIGS. 1 and 2) and an impedance matching structure 132 also are formed on the surface of the dielectric structure 120 (FIGS. 1 and 2) opposite the metal layer 115. In operation, the EBG structure 130 attenuates electromagnetic wave coupling along the outer surface 111 of the dielectric layer 120 (FIGS. 1 and 2). The EBG structure 130 helps to force the energy from an input signal received through a launch structure in to the cavity 112.

A waveguide 150 (FIGS. 1 and 2) is bonded to the impedance matching structure and thus over the loops 135 and 117. The waveguide 150 may comprise a rectangular waveguide. In one embodiment, the waveguide 150 is a rectangular WR5 waveguide having dimensions of the inner opening 151 of D1 and D2 (as shown in FIG. 1), where D1 is approximately 0.0510 inches and D1 is approximately 0.0255 inches. Waveguide sizes other than WR5 may be included in other embodiments (e.g., WR4, WR12, etc.). Radio frequency (RF) signals within a frequency range of 140 GHz to 220 GHz can be provided into the waveguide 150. Such signals cause a current to be generated in inductive loop 135, which causes a current to be generated in inductive loop 117 on the opposite side of the dielectric structure 120. The energy from the RF signal of the inductive loop 117 is then injected into the cavity 112.

As noted above, the cavity 112 may contain dipolar molecules (e.g., water). At a precise frequency (e.g., 183.31 GHz for water molecules), the dipolar molecules absorb the energy. The launch structure may include a pair of structures such as that shown in FIG. 1 (and the other embodiments disclosed herein) including the waveguide 150 and inductive loops 117, 135—one such structure injects the RF energy into the cavity, and the other structure receives the signal from the cavity to be monitored by an external circuit. The term "launch structure" may refer to either or both of these structures to inject an RF signal into, and/or receive a signal from, the cavity 112.

Figure 3:
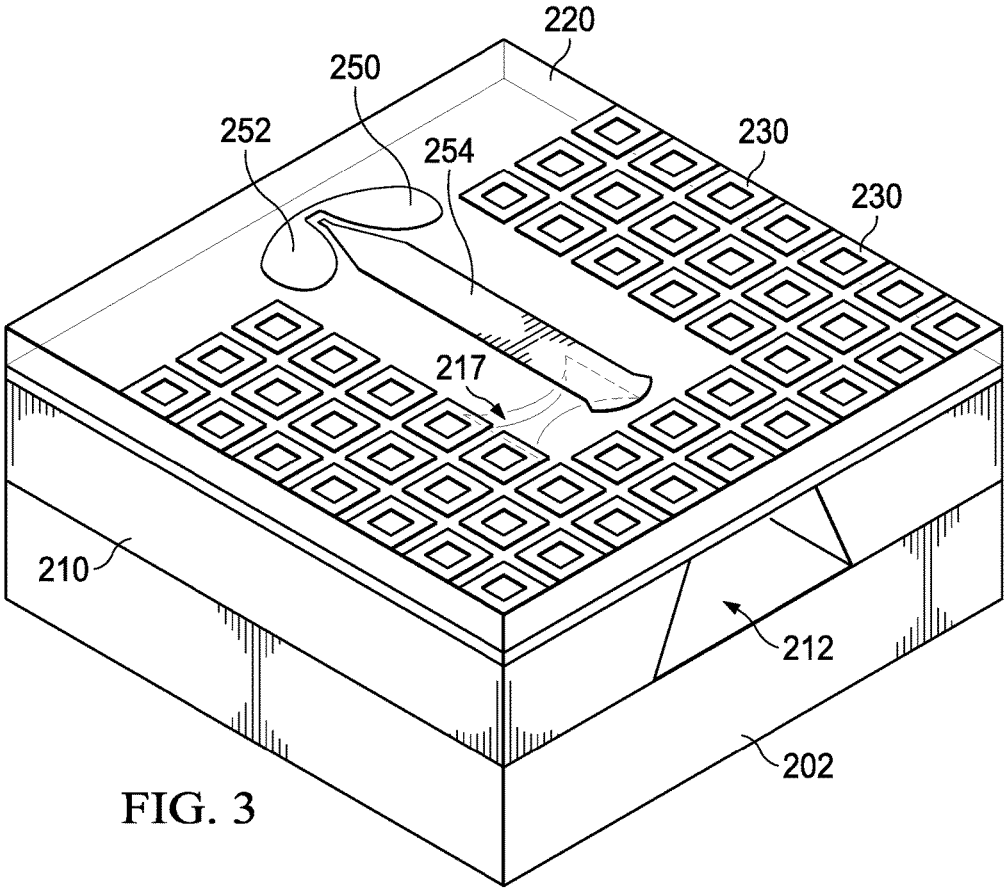
FIGS. 3-5 illustrate another embodiment of a launch structure comprising coplanar waveguide and a bowtie iris through which radio frequency (RF) energy is coupled into, or remove from a sealed cavity in accordance with various examples.
Figure 4:
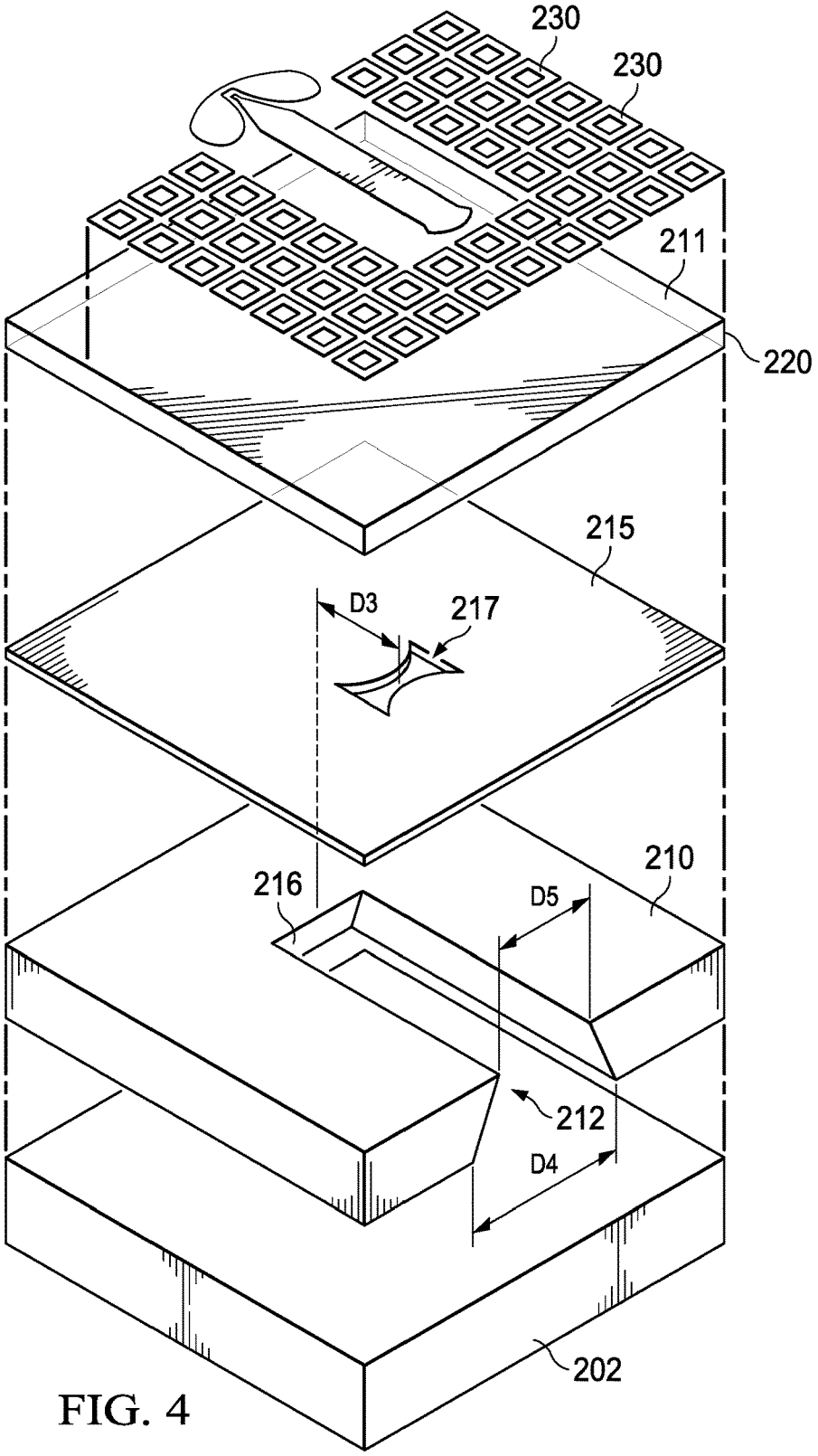
Figure 5:
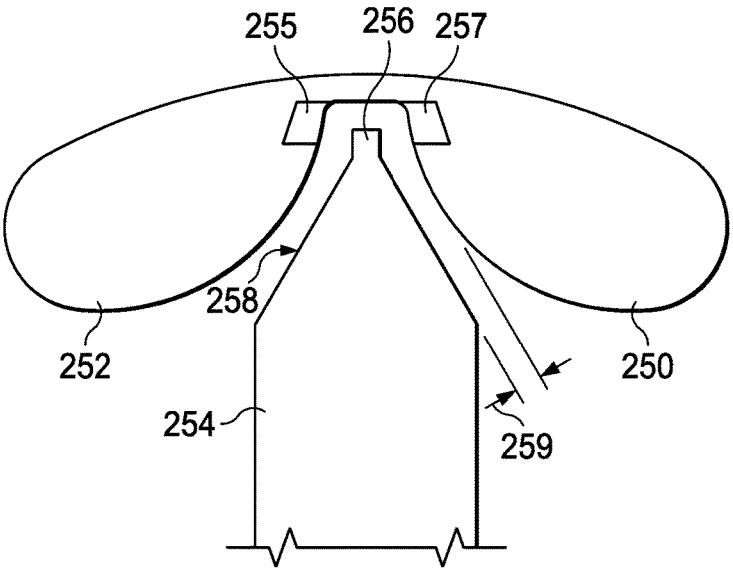

FIGS. 3-5 illustrate an example of another launch structure in accordance with another embodiment. In this example (as shown in FIGS. 3 and 4), a cavity 212 is formed within one substrate 210 (e.g., semiconductor or other type of material). Substrate 210 is bonded to a second substrate 202 (e.g., e.g., semiconductor or other type of material) to hermetically seal the cavity 212. A metal layer 215 (FIG. 4) is deposited on a surface of substrate 210 opposite substrate 202. The metal layer 215 may comprise copper, gold, other type of metal. An iris 217 is patterned in the metal layer 215. The iris 217 is patterned by removing a portion of the metal layer 215 (e.g., by liftoff, wet etch, or other suitable processes). As best seen in FIGS. 3 and 4, the iris has a "bowtie" shape. The iris can have other shapes as well, such as rectangular, chevron, U-shaped, etc.

A dielectric structure 220 (e.g., glass or other non-conductive material) is bonded to the metal layer 215, and an EBG 230 is formed on the surface of the dielectric structure 220 opposite the metal layer 215. As explained above, the EBG structure 230 attenuates electromagnetic wave coupling along the outer surface 211 (FIG. 4) of the dielectric layer 220. The EBG structure 230 helps to force the energy from an input signal received through a launch structure into the cavity 212.

The launch structure in this example includes an input formed as a coplanar waveguide comprising a pair of ground contacts 255 and 257 (FIG. 5) formed on opposite sides of a signal contact 256 (FIG. 5). Each ground contact 255, 257 is part of a curved lobe 252 and 250, respectively (as shown in FIGS. 3 and 5). A microstrip conductor 254 extends from an area near the curved lobes 250, 252 to an area that is over the iris 217 as shown in FIG. 3. FIG. 5 shows a close-up view of a portion of the microstrip conductor 254 near the curved lobes with the ground contacts 255, 257. The signal contact 256 (FIG. 5) transitions into an expanding conductive element 258, which in turn extends into a generally rectangular conductive strip. The expanding conductive element 258 is separated from each of the curved lobes (as illustrated by reference numeral 259) by a distance that generally increases from the signal contact 256 along the microstrip as shown.

Although in some embodiments, the cavity may be rectangular in cross section, in the example of FIGS. 3 and 4, the cross sectional shape of the cavity is trapezoidal resulting from the process of wet etching the cavity. The substrate 202 is bonded to substrate 210 along the surface of substrate 202 containing the wide dimension D4 (FIG. 4) of the trapezoidal shape. The metal layer 215 is bonded to substrate 210 adjacent the surface containing the narrow dimension D5 (FIG. 4) of the trapezoidal shape. FIG. 4 illustrates the location of the iris 217 with respect to the cavity 212. One end of the cavity is identified by reference numeral 216. The iris 217 is positioned so that the distance between the center of the iris 217 and cavity edge 216 (designated as dimension D3 in FIG. 4) is an integer multiple of ½ of the wavelength of the RF signal to be injected into the cavity. The integer is 1 one or greater. As such, in some embodiments, the iris 217 is one-half wavelength away from the cavity edge 216. The relevant wavelength may vary from application to application. For a cavity 212 containing water molecules and for some geometries, the wavelength is 2 mm, and thus one-half wavelength is 1 mm.

Figure 6:
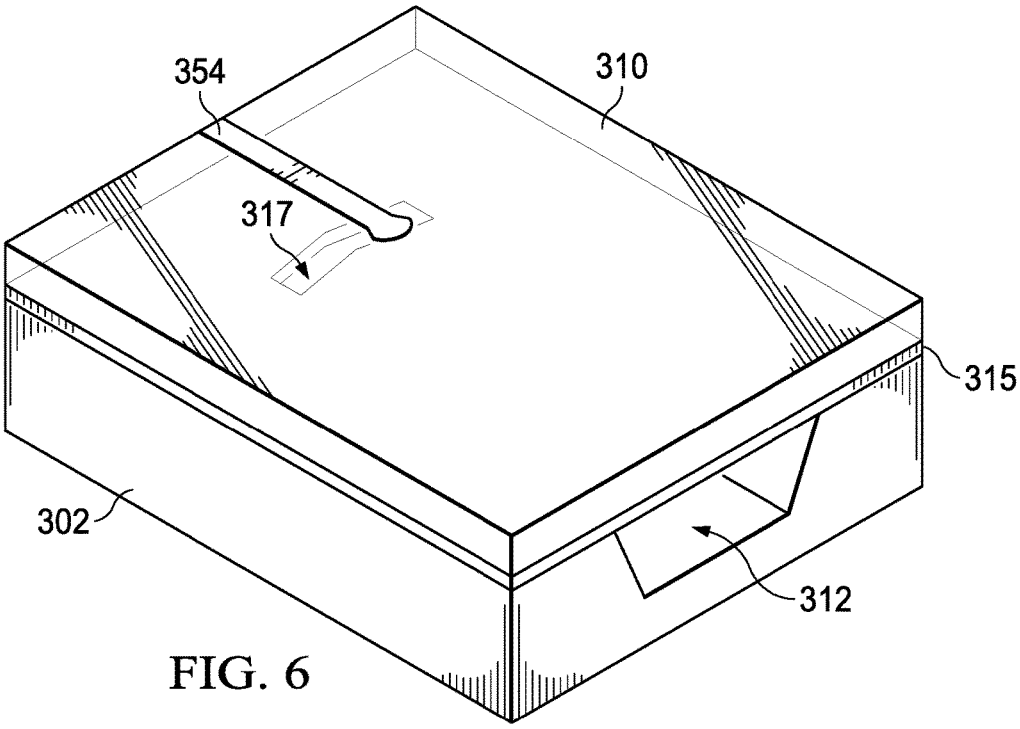
FIGS. 6 and 7 illustrate another embodiment of a launch structure comprising a chevron-shaped iris formed in a metal layer over a sealed cavity.
Figure 7:
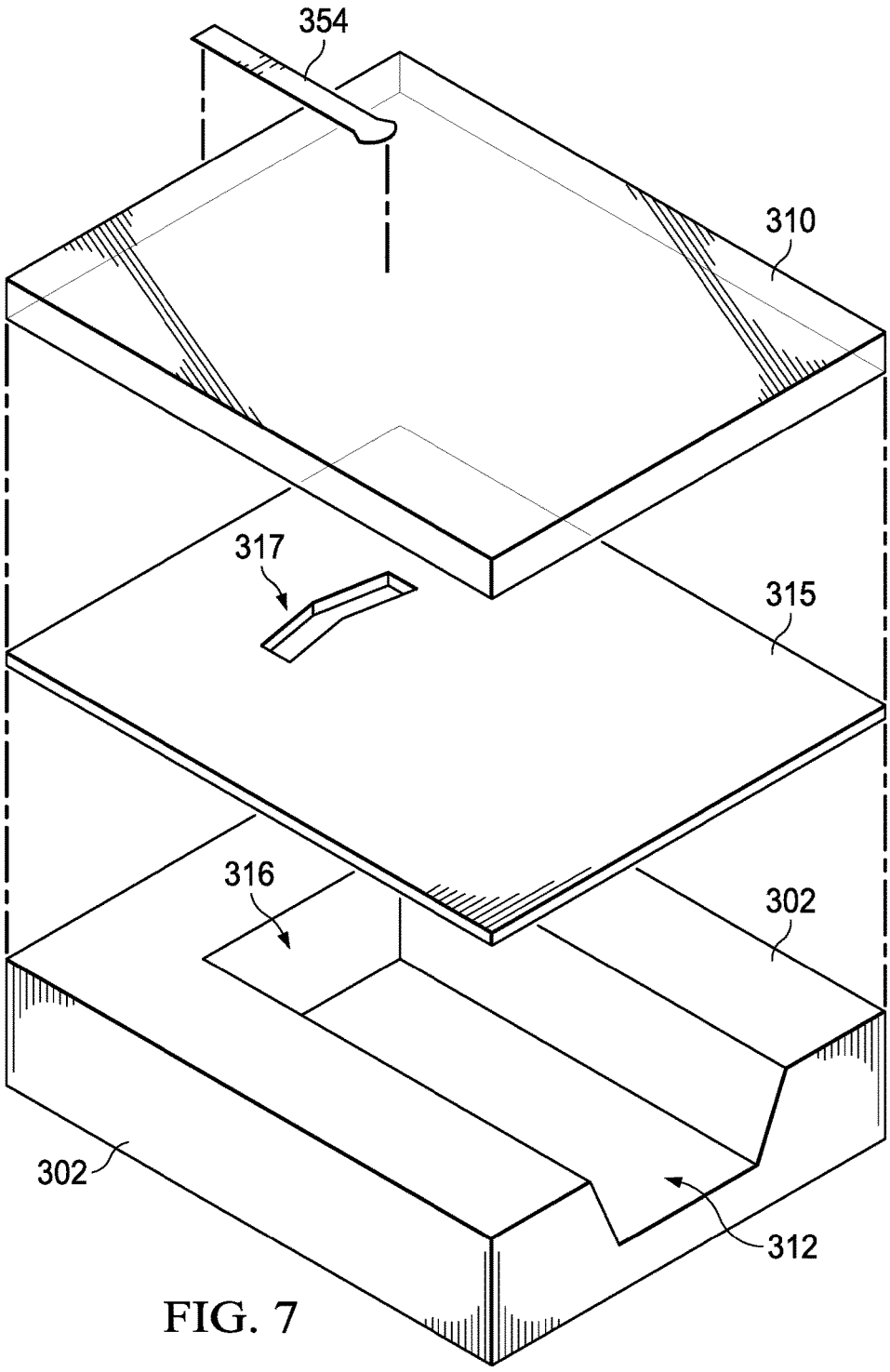

FIGS. 6 and 7 illustrate another launch structure in accordance with another embodiment. In this example, a cavity 312 is formed within a substrate 302 (e.g., semiconductor or other type of material). A metal layer 315 is deposited on a surface of substrate 302 so as to seal the cavity 312. The metal layer 315 may comprise copper, gold, or other type of metal. An iris 317 is patterned in the metal layer 315. The iris 317 is patterned by removing a portion of the metal layer 315 (e.g., by liftoff, wet etch, or other suitable processes). In this example, the iris 317 has a chevron shape. A dielectric structure 310 (e.g., glass or other non-conductive material) is bonded to the metal layer 315. The launch structure in this example may include a coplanar waveguide, the same or similar to that shown in the example of FIGS. 3-5. One end of a microstrip 354 extends over the chevron-shaped iris 317 as shown in FIG. 6.

The cavity in this example is in the opposite orientation as shown in FIGS. 3 and 4. That is, the metal layer 315 is bonded to a surface of the substrate 302 containing the wide dimension of the cavity's cross sectional shape. In this example, the iris 317 is located vertically generally adjacent end 316 (FIG. 7) of the cavity 312.

Figure 8:
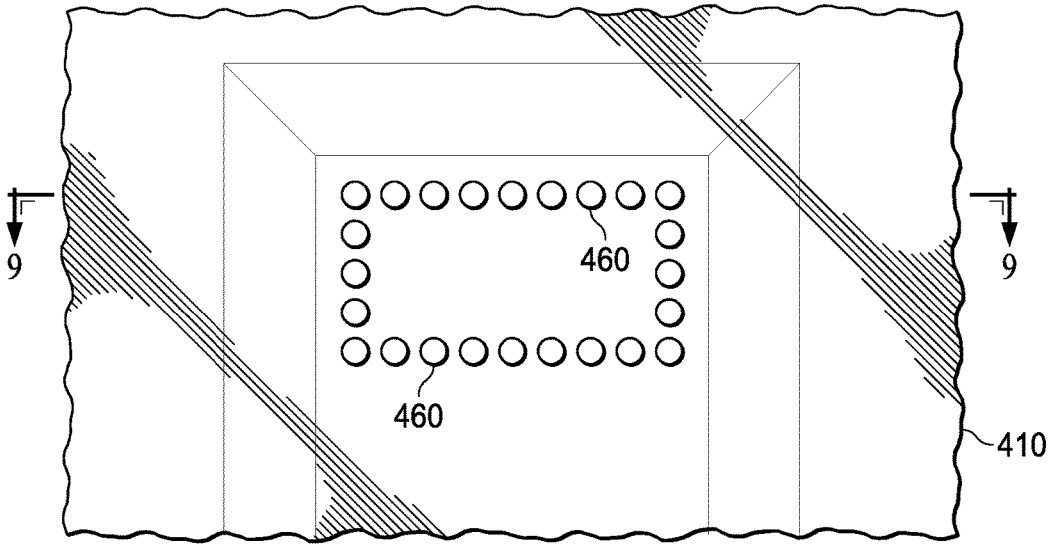
FIGS. 8-10 illustrate another embodiment of an arrangement of vias containing metal to couple RF energy from a rectangular waveguide into a sealed cavity.
Figure 9:
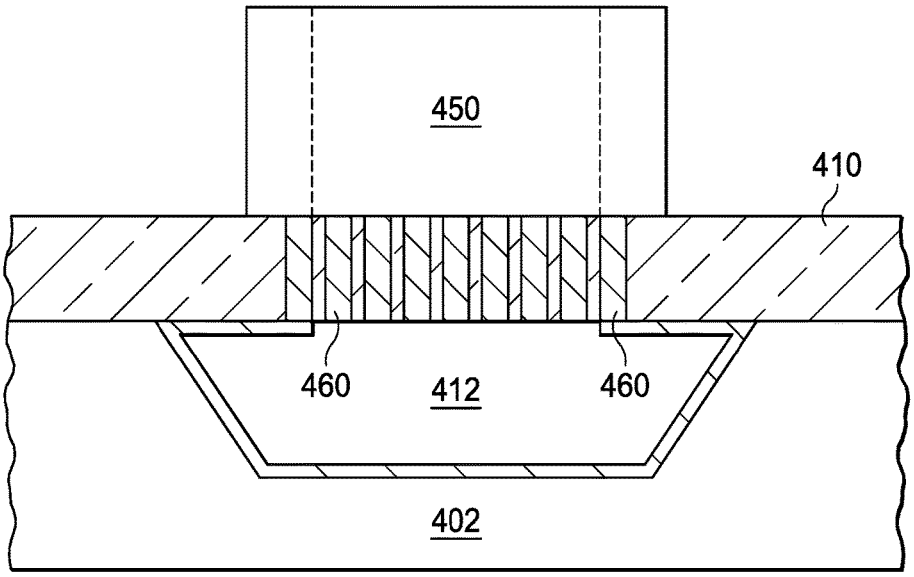
Figure 10:
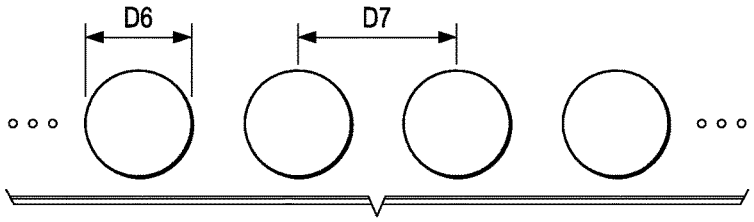

FIGS. 8-10 illustrate another embodiment of a launch structure for a hermetically sealed cavity. FIG. 8 shows a top view, and FIG. 9 shows a cross sectional plan view. In this example, as shown in FIGS. 8 and 9, a waveguide 450 (e.g., a rectangular waveguide, such as WR5 waveguide as shown in FIG. 9) is attached to a surface of a dielectric structure 410 opposite a substrate 402 (FIG. 9). The substrate 402 may comprise semiconductor material or other suitable type of material as noted above. A cavity 412 (FIG. 9) is formed within the substrate 402 and is hermetically sealed. An arrangement of vias 460 extend through the dielectric structure 410. The arrangement of the vias 460 generally matches the cross sectional shape of the waveguide 450. In the example of FIGS. 8 and 9, the waveguide is rectangular in cross section, and thus the arrangement of vias 460 also is rectangular. The arrangement of vias 460 generally outlines the interior dimensions of the waveguide 450.

The vias 460 may include metal (e.g., copper, aluminum). In some embodiments, each via is fully filled with metal. In other embodiments, each via may be partially filled with metal. Each via is generally circular in cross section. The diameter D6 (FIG. 10) of each via and the spacing between vias (D7 as shown in FIG. 10) is ultimately determined by the upper cutoff frequency of the waveguide and the fabrication process capabilities. In some embodiments, the dimensions D6 and D7 may be smaller than the minimum wavelength in the waveguide. For example, D7<2*D6 and D6$<\lambda_{g_min}/5$. For a millimeter wave system with a large relative dielectric constant ($\in_r$), however, an approximately 100 nm diameter via (D6) with a spacing (D7) on the same order (in the range of 200-300 nm pitch) and an aspect ratio (height:diameter) greater than 10:1 may be used implemented. A wide variety of ratios (D6/D7) are possible ranging from ~0.3-0.9. This ratio is a function of the relative dielectric constant of the bonded substrate and dielectric, the opening dimensions of the launch, the bandwidth required of the launch, and the fabrication tolerances of the manufacturing process. In such cases, it is likely that the densest metallization achievable may be optimal, but the designer can employ numerical modeling to find the optimal configuration to minimize signal loss. Further, resonances can be tuned about a frequency of interest. Finally, the insertion loss, return loss, and impedance of the launch may rely on computational electromagnetics to analyze and optimize this pitch ratio within the above constraints.

Figure 11:
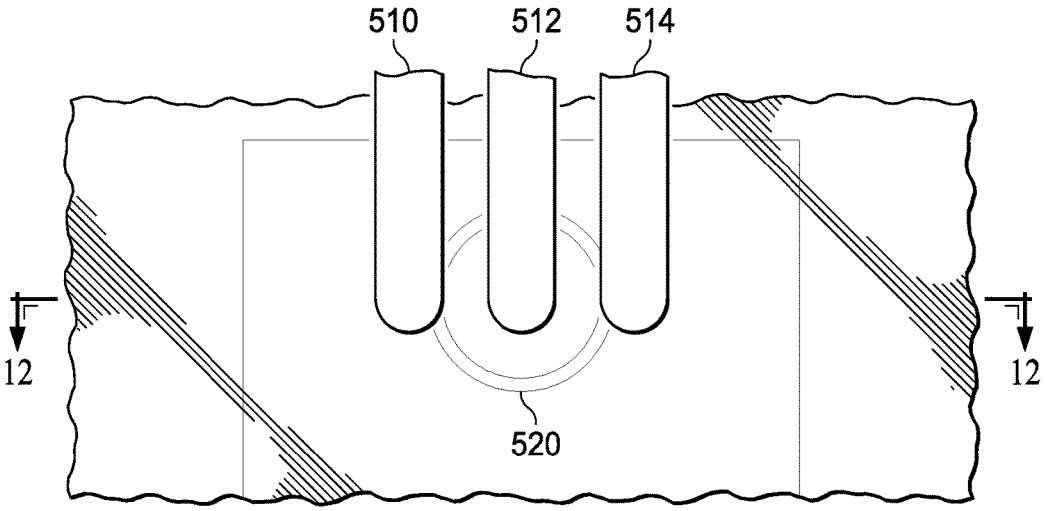
FIGS. 11 and 12 illustrate a launch structure in which a coplanar waveguide is transitioned to a coaxial waveguide in accordance with some embodiments.
Figure 12:
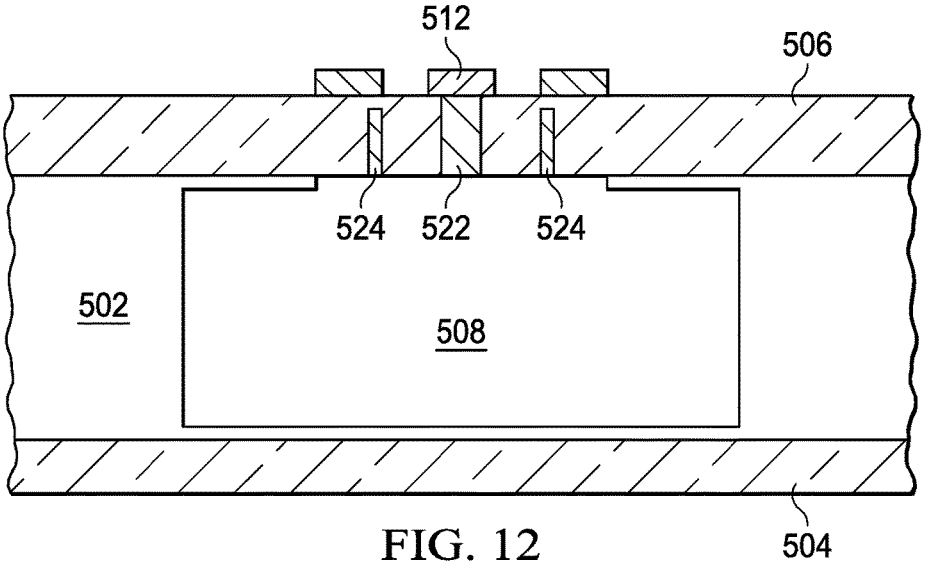

FIGS. 11 and 12 illustrate yet another embodiment of a launch structure. A coplanar waveguide comprising two ground conductors 510 and 514 (as shown in FIG. 11) on either side of a signal conductor 512 extend along an upper surface of a ceramic structure 506 (e.g., alumina) deposited on one surface of a substrate 502 (as shown in FIG. 12) (e.g., a semiconductor or metal substrate). Another ceramic structure 504 (FIG. 12) is deposited on the other side of the substrate 502 (FIG. 12) from substrate 506 (FIG. 12). A cavity 508 (FIG. 12) is formed in the substrate 502 (FIG. 12) and hermetically sealed. The coplanar waveguide comprising conductors 510, 512, and 514 (FIG. 11) ends to a generally circular connection ring 520 (FIG. 11). The connection ring 520 resides in a different plane than the coplanar waveguide, generally closer to the cavity 508. The two ground conductors 510 and 514 electrically connect to different portions of the connection ring 520 through vertical conductive vias 524 (FIG. 12). The signal conductor 512 connects through a vertical conductive via 522 (FIG. 12) to a central point within the conductive ring, thereby forming a coaxial waveguide. Thus, the launch structure transitions a coplanar waveguide into a coaxial waveguide for insertion of RF signals into, and removal of RF signals from, a hermetically sealed cavity.

Figure 13:
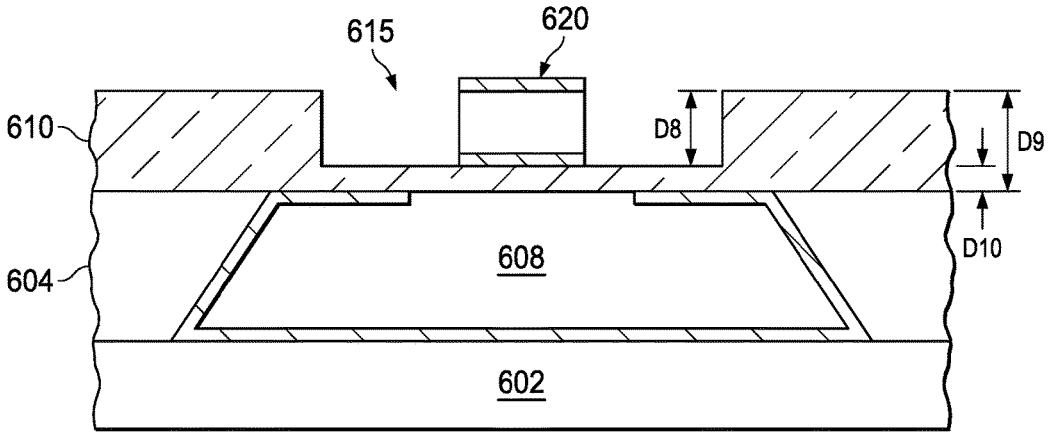
FIG. 13 illustrates a launch structure residing within a recess formed in a dielectric structure adjacent a sealed cavity in accordance with some embodiments.

FIG. 13 illustrates another launch structure. Substrates 602 and 604 (e.g., semiconductor or other materials) are bonded together with a cavity 608 having been formed (e.g., by a wet etching process). The cavity 608 is hermetically sealed. A dielectric structure 610 (e.g., glass) is bonded to a surface of the substrate 604 opposite substrate 602. A recess 615 is formed (e.g., etched) into the dielectric structure 610. The depth of the dielectric structure 610 is represented as D9 and the depth of the recess 615 is represented as D8. Dimension D8 is smaller than D9. A transmission line 620 is placed within the recess 615. As such, the thickness D10 of the dielectric structure between the transmission line 620 and the sealed cavity 608 is smaller than would have been the case absent the recess. As such, the launch structure of FIG. 13 promotes a more efficient coupling of RF energy between transmission line 620 and cavity 608, and vice versa.

Figure 14:
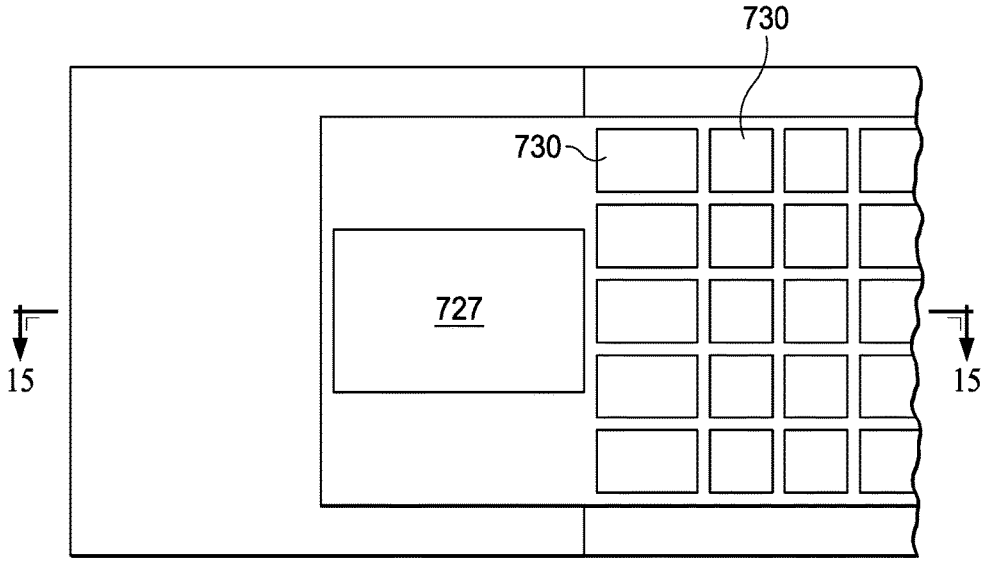
FIGS. 14 and 15 illustrate yet another embodiment of a launch structure in accordance with various embodiments.
Figure 15:
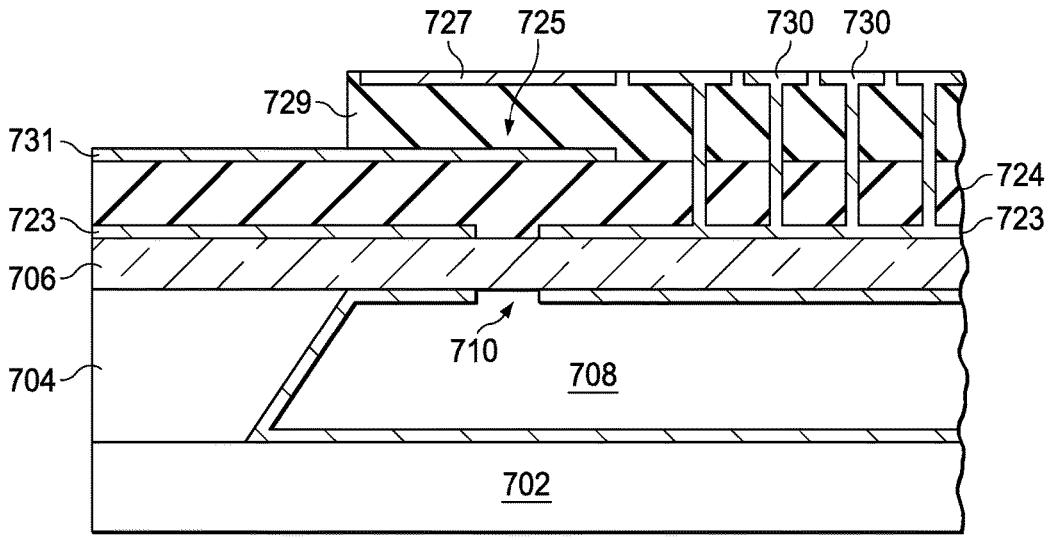

FIGS. 14 and 15 illustrate yet another embodiment of a launch structure. As shown in FIG. 15, substrates 702 and 704 (e.g., semiconductor or other materials) are bonded together with a cavity 708 having been formed (e.g., by a wet etching process). The cavity 708 is hermetically sealed. A dielectric structure 706 (e.g., glass) is bonded to a surface of the substrate 704 opposite substrate 702. An iris 710 is formed in a metal layer underlying the dielectric structure 706 to permit the passage of RF energy into, or out of, the cavity 708. A metal layer 723 (FIG. 15) is formed on a surface of the dielectric structure 706 opposite the substrate 704. The metal layer 723 may be grounded. An additional dielectric layer 724 (FIG. 15) is then deposited on the metal layer 723 opposite the dielectric structure 706. A conductive antenna 725 (FIG. 15) is formed on the dielectric layer 724 as part of a conductive layer 731 (FIG. 15) as shown, generally over the iris 710. EBG structures 730 (FIGS. 14 and 15) also may be included on an upper surface of the dielectric layer 729 as shown in FIG. 15 and connected to metal layer 723. Metal layer 723 represents the common ground plane for all surface patterned electromagnetic structures including RF feeds 731, EBG 730, defected ground structures, or ground reflectors 727 (FIGS. 14 and 15) for the launching structure. The secondary dielectric 729 allows for reduced RF transmission losses as well as the patterning of either ground reflectors or defected ground planes above the launch itself. It also supports a multilayer EBG. The combination of metal layer 723, dielectric layer 724, conductive layer 731, secondary dielectric layer 729, and reflectors 727 (FIGS. 14 and 15) allow for the fabrication of more complex exterior transmission structures such as a stripline or substrate integrated waveguide to reduce RF losses transmitting a signal between an integrated circuit (IC) which may not be mounted in immediate proximity to the cavity launch structure for either transmit or receive.

Figure 16:
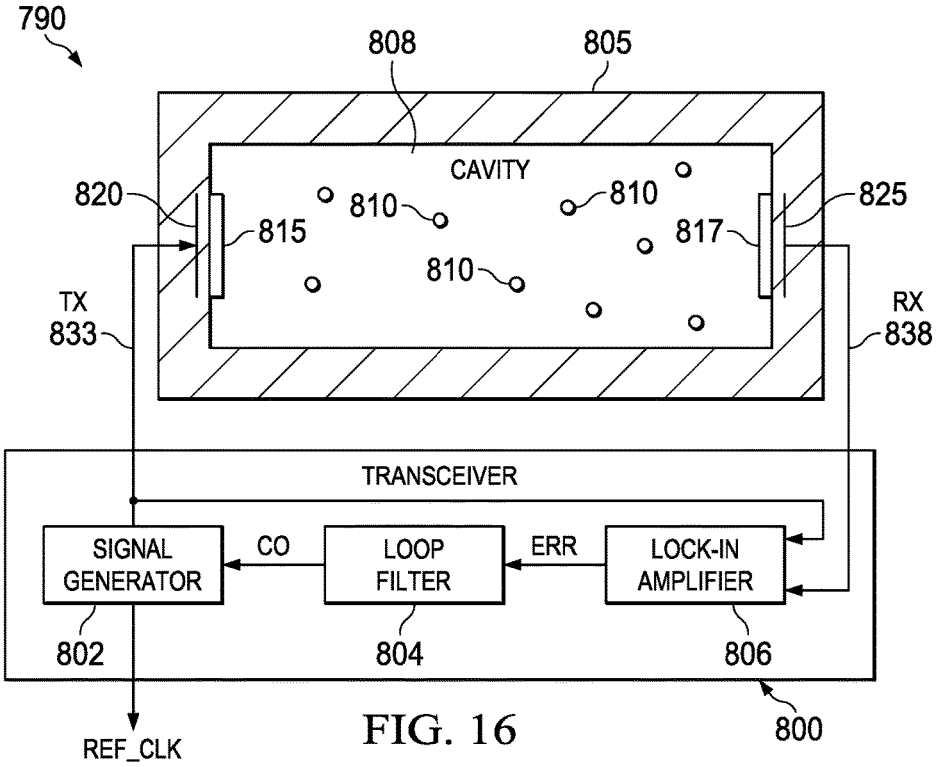
FIG. 16 shows a block diagram of a clock generator in accordance with various embodiments.

FIG. 16 shows a block diagram for a clock generator 790 in accordance with various embodiments. The clock generator 790 is a millimeter wave atomic clock that generates a reference frequency based on the frequency of quantum rotation of selected dipolar molecules contained in a hermetically sealed cavity (e.g., any of the cavities disclosed herein). The reference frequency produced by quantum rotation of the selected dipolar molecules is unaffected by circuit aging and does not vary with temperature or other environmental factors.

The clock generator 790 of FIG. 16 includes a vapor cell 805 in accordance with any of the embodiments described herein. The vapor cell 805 includes a cavity 808 with a sealed interior enclosing a dipolar molecule material gas 810, for example, water ($H_2O$) or any other dipolar molecule gas at a relatively low gas pressure inside the cavity 808. Non-limiting examples of suitable electrical dipolar material gases include water, acetonitrile ($CH_3CN$) and hydrogen cyanide (HCN). As shown in FIG. 16, the clock generator 790 further includes a transceiver 800 with a transmit output 833 for providing an electrical transmit signal (TX) to the vapor cell 805, as well as a receiver input 838 for receiving an electrical input signal (RX) from the vapor cell 805. The quantum rotation vapor cell 805 does not require optical interrogation, and instead operates through electromagnetic interrogation via the transmit and receive signals (TX, RX) provided by the transceiver 800.

The sealed cavity 808 includes a conductive interior cavity surface, as well as first and second non-conductive apertures 815 and 817 (e.g., the dielectric structures described above) formed in the interior cavity surface for providing an electromagnetic field entrance and an electromagnetic field exit, respectively. In one example, the apertures 815, 817 magnetically couple into the TE10 mode of the cavity 808. In other examples, the apertures 815, 817 excite higher order modes. A first conductive coupling structure 820 and a second conductive coupling structure 825 are formed on an outer surface of the vapor cell 805 proximate the first and second non-conductive apertures 815, 817. The first and second conductive coupling structures 820, 825 may be any of the launch structures described above and may comprise a conductive strip formed on a surface of one of the substrates forming the cell 805. Each coupling structure 820, 825 may overlie and cross over the corresponding non-conductive aperture 815, 817 for providing an electromagnetic interface to couple a magnetic field into (based on the transmit signal TX from the transceiver output 833) the cavity 808 or from the cavity to the transceiver RX input 838. The proximate location of the first and second conductive coupling structures 820, 825 and the corresponding non-conductive apertures 815, 817 advantageously provides electromagnetically transmissive paths through a substrate, which can be any electromagnetically transmissive material.

The transceiver circuit 800 in certain implementations is implemented on or in an integrated circuit (not shown), to which the vapor cell 805 is electrically coupled for transmission of the TX signal via the output 833 and for receipt of the RX signal via the input 838. The transceiver 800 is operable when powered for providing an alternating electrical output signal TX to the first conductive coupling structure 820 for coupling an electromagnetic field to the interior of the cavity 808, as well as for receiving the alternating electrical input signal RX from the second conductive coupling structure 825 representing the electromagnetic field received from the cavity 808. The transceiver circuit 800 is operable for selectively adjusting the frequency of the electrical output signal TX in order to reduce the electrical input signal RX by interrogation to operate the clock generator 790 at a frequency which substantially maximizes the molecular absorption through rotational motor state transitions, and for providing a reference clock signal REF_CLK at the frequency of the TX output signal.

In certain examples, the transceiver 800 includes a signal generator 802 with an output 833 electrically coupled with the first conductive coupling structure 820 for providing the alternating electrical output signal TX, and for providing the reference clock signal REF_CLK at the corresponding transmit output frequency. The transceiver 800 also includes a lock-in amplifier circuit 806 with an input 838 coupled from the second conductive coupling structure 825 for receiving the RX signal. The lock-in amplifier operates to provide an error signal ERR representing a difference between the RX signal and the electrical output signal TX. In one example, the lock-in amplifier 806 provides the error signal ERR as an in-phase output, and the error signal ERR is used as an input by a loop filter 804 to provide a control output signal (CO) to the signal generator 802 for selectively adjusting the TX output signal frequency to maintain this frequency at a peak absorption frequency of the dipolar molecular gas inside the sealed interior of the cavity 808. In some examples, the RF power of the TX and RX loop is controlled so as to avoid or mitigate stark shift affects.

The electromagnetic coupling via the non-conductive apertures 815, 817 (FIG. 16) and corresponding conductive coupling structures 820, 825 facilitates electromagnetic interrogation of the dipolar gas within the cell cavity 808. In one non-limiting form of operation, the clock generator 790 operates with the signal generator 802 transmitting alternating current (AC) TX signals at full transmission power at various frequencies within a defined band around a suspected quantum absorption frequency at which the transmission efficiency of the vapor cell 805 is minimal (absorption is maximal). For example, the quantum absorption frequency associated with the dipolar water molecule is 183.31 GHz. When the system operates at the quantum frequency, a null or minima is detected at the receiver via the lock-in amplifier 806, which provides the error signal ERR to the loop filter 804 for regulation of the TX output signal frequency via the control output CO signal provided to the signal generator 802. The rotational quantum frequency of the dipolar molecule gas 810 in the vapor cell cavity 808 is generally stable with respect to time (does not degrade or drift over time), and is largely independent of temperature and a number of other variables.

In one embodiment, the signal generator 802 initially sweeps the transmission output frequency through a band known to include the quantum frequency of the cell 505 (e.g., transitioning upward from an initial frequency below the suspected quantum frequency, or initially transitioning downward from an initial frequency above the suspected quantum frequency, or other suitable sweeping technique or approach). The transceiver 800 monitors the received energy via the input 838 coupled with (e.g., electrically connected to) the second conductive coupling structure 825 in order to identify the transmission frequency associated with peak absorption by the gas in the cell cavity 808 (e.g., minimal reception at the receiver). Once the quantum absorption frequency is identified, the loop filter 804 moves the source signal generator transmission frequency close to that absorption frequency (e.g., 183.31 GHz), and modulates the signal at a very low frequency to regulate operation around the null or minima in the transmission efficiency representing the ratio of the received energy to the transmitted energy. The loop filter 804 provides negative feedback in a closed loop operation to maintain the signal generator 802 operating at a TX frequency corresponding to the quantum frequency of the cavity dipolar molecule gas.

In steady state operation, the lock-in amplifier 806 and the loop filter 804 maintain the transmitter frequency at the peak absorption frequency of the cell gas. In one non-limiting example, the loop filter 804 provides proportional-integral-derivative (PID) control using a derivative of the frequency error as a control factor for lock-in detection and closed loop regulation. At the bottom of the null in a transmission coefficient curve, the derivative is zero and the loop filter 804 provides the derivative back as a direct current (DC) control output signal CO to the signal generator 802. This closed loop operates to keep the signal generator transmission output frequency at the peak absorption frequency of the cell gas using lock-in differentiation based on the RX signal received from the cell 808. The REF_CLK signal from the signal generator 802 is the TX signal clock and can be provided to other circuitry such as frequency dividers and other control circuits requiring use of a clock.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. An apparatus, comprising:

a substrate having a cavity;

a dielectric structure covering at least a portion of the cavity, the cavity being hermetically sealed; and a launch structure formed on the dielectric structure and outside the hermetically sealed cavity, the launch structure configured to cause radio frequency (RF) energy flowing in a first direction to flow through the dielectric structure to the hermetically sealed cavity in a direction orthogonal to the first direction.

2. The apparatus of claim 1, wherein the dielectric structure includes a first portion and a second portion, the second portion is thinner than the first portion, and the launch structure resides on the second portion.

3. The apparatus of claim 1, wherein the launch structure includes a radio frequency (RF) feed, a dielectric layer over the RF feed, and a ground reflector on a side of the dielectric layer opposite the RF feed.

4. The apparatus of claim 1, wherein the dielectric structure has opposite first and second surfaces, the first surface faces toward the cavity, the second surface faces away from the cavity, the launch structure includes a coplanar waveguide on the second surface, and the apparatus further comprises a metal layer between the dielectric structure and the substrate, the metal layer including an iris through which the RF energy enters the cavity from the coplanar waveguide, the iris underlying a portion of the coplanar waveguide and overlying the cavity.

5. The apparatus of claim 4, wherein the iris includes a bowtie-shaped iris.

6. The apparatus of claim 4, wherein the iris includes a chevron-shaped iris.

7. The apparatus of claim 1, wherein the launch structure includes:

a coplanar waveguide including a signal transmission element between two ground elements; and a metal ground ring to which each of the two ground elements electrically connects;

the signal transmission element terminating at the center of the metal ground ring.

8. An apparatus, comprising:

a substrate having a cavity;

a dielectric structure covering at least a portion of the cavity, the cavity being hermetically sealed;

a launch structure formed on the dielectric structure and outside the hermetically sealed cavity, the launch structure configured to cause radio frequency (RF) energy flowing in a first direction to flow through the dielectric structure to the hermetically sealed cavity in a direction orthogonal to the first direction; and a transceiver electrically coupled to the launch structure, the transceiver configured to inject a transmit signal into the cavity through the launch structure, to receive a receive signal from the cavity through the launch structure, and to generate an error signal based on the transmit signal and the receive signal, and to dynamically adjust a frequency of the transmit signal based on the error signal.

9. The apparatus of claim 8, wherein the dielectric structure includes a first portion and a second portion, the second portion is thinner than the first portion, and the launch structure resides on the second portion.

10. The apparatus of claim 8, wherein the launch structure includes a radio frequency (RF) feed, a dielectric layer over the RF feed, and a ground reflector on a side of the dielectric layer opposite the RF feed.

11. The apparatus of claim 8, wherein the launch structure includes:

a coplanar waveguide including a signal transmission element between two ground elements; and a metal ground ring to which each of the two ground elements electrically connects;

the signal transmission element terminating at the center of the metal ground ring.

12. The apparatus of claim 8, wherein the dielectric structure has opposite first and second surfaces, the first surface faces toward the cavity, the second surface faces away from the cavity, the launch structure includes a coplanar waveguide on the second surface, and the apparatus further comprises a metal layer between the dielectric structure and the substrate, the metal layer including an iris through which the RF energy enters the cavity from the coplanar waveguide, the iris underlying a portion of the coplanar waveguide and overlying the cavity.

13. The apparatus of claim 12, wherein the iris includes a bowtie-shaped iris.

14. The apparatus of claim 12, wherein the iris includes a chevron-shaped iris.

* * * * *